United States Patent [19]

Hipskind

[11] 4,124,196

[45] Nov. 7, 1978

[54] PORTABLE DEVICE FOR SCREENING OFF AN ACCIDENT SCENE FROM VIEW

[76] Inventor: Myron M. Hipskind, 2 Oak Brook Club Dr. Res. C 101, Oak Brook, Ill. 60521

[21] Appl. No.: 776,441

[22] Filed: Mar. 10, 1977

[51] Int. Cl.[2] ..... E04H 17/00

[52] U.S. Cl. ..... 256/1; 256/24; 116/63 P; 160/24

[58] Field of Search ..... 160/24, 23 R; 135/5 A, 135/1 A; 256/1, 13.1, 25, 24; 40/85, 125 N; 404/6, 9; 116/63 P

[56] References Cited

U.S. PATENT DOCUMENTS

| | | | |
|---|---|---|---|
| 193,573 | 7/1877 | Tripp | 160/24 X |
| 376,436 | 1/1888 | Harrison | 160/24 |
| 1,627,906 | 5/1927 | Jones | 160/24 |
| 1,719,055 | 7/1929 | Herzer | 135/1 A |
| 1,912,231 | 5/1933 | Wandscheer | 135/1 A |
| 2,646,097 | 7/1953 | Gaverth et al. | 135/1 A |
| 2,724,395 | 11/1955 | Valentine | 135/1 A |
| 2,887,983 | 5/1959 | Budd | 40/125 N |
| 3,220,464 | 11/1965 | Wise | 160/24 |

*Primary Examiner*—Andrew V. Kundrat

[57] ABSTRACT

In a device for rapidly screening off a traffic accident site from view a non-transparent elongate sheet of a thin flexible material has one of its short ends secured to a spring-activated rod in the nature of a curtain rod on which the sheet is windable, said rod being mounted lengthwise within a portable cylindrical container having a longitudinal slot through which the sheet is movable for winding and unwinding purposes while being prevented from passing entirely into said container through said slot. The container is provided at one end thereof with means for readily and releasably connecting the same in an upright position with a stationary object, while a supporting post is connectible to said sheet at the free end thereof and adapted to be secured to a stationary object at a distance from said firstmentioned stationary object to thus support the unwound sheet in a substantially vertical position.

6 Claims, 5 Drawing Figures

PORTABLE DEVICE FOR SCREENING OFF AN ACCIDENT SCENE FROM VIEW

Figure 1:
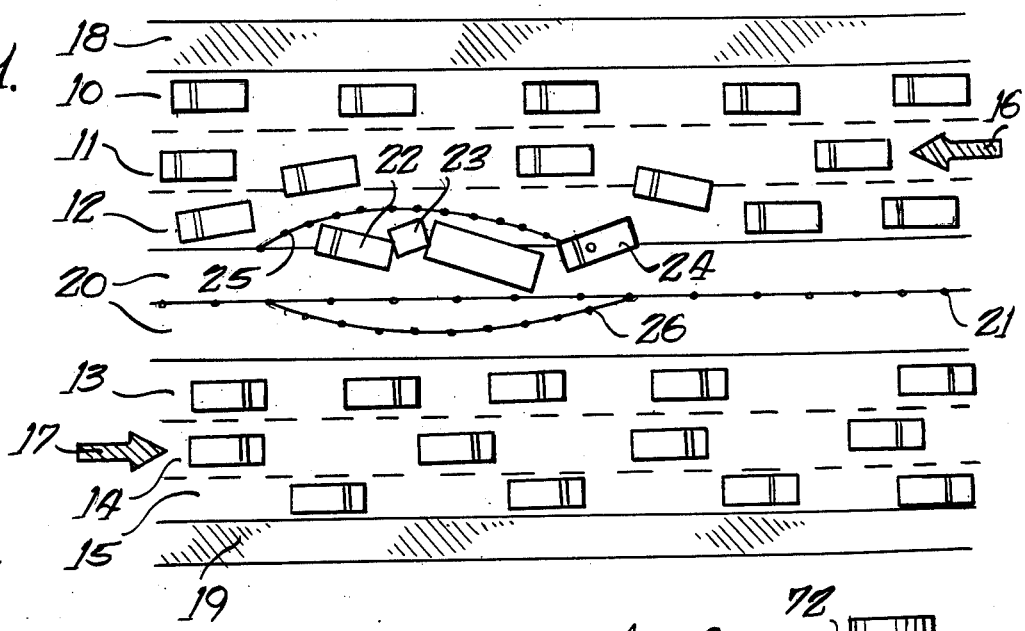

This invention relates to novel means for enhancing road traffic safety by preventing accidents and other complications frequently caused by curiosity and unwarranted activities on the part of travellers on a roadway passing the scene of a previous accident under clean-up and investigation by rescue and law enforcement personnel.

Under present-day traffic conditions on express and highways, particularly in unfavorable weather, it is a common occurrence that a more or less serious accident becomes the cause of traffic jams and/or additional accidents due to the fact that other travellers slow down or even stop in the vicinity of the original accident scene in order to view the scene or, perhaps, in some cases to bring assistance to victims. It is a well known fact, that such behaviors frequently continue even after the arrival of emergency vehicles, such as police or patrol cars, towing cars, fire trucks, ambulances or the like, in spite of the fact that the rescue work would be greatly facilitated, if the road traffic proceeded as unhampered as possible.

The prime object of the present invention is to provide means, whereby a roadside accident scene may be rapidly and effectively shielded from view.

Another object of the invention is to provide a screen and supporting equipment which can be conveniently carried by an emergency vehicle and readily erected in position to prevent travellers from viewing the accident scene and associated rescue and clean-up activities.

A further object of the invention is to provide a screen for the purpose indicated, which is made of a thin, light-weight, opaque material and adapted to be routinely carried by emergency vehicles in a rolled-up condition similar to that of an ordinary window shade wrapped around a spring-actuated curtain rod.

Yet another object of the invention is to provide a screen of the kind indicated which has a multiplicity of perforations there-through distributed over its entire surface in order to reduce wind pressure on the screen in erected condition.

A still further object of the invention is to provide means for supporting the inventive screen in proper position at the accident scene, said means comprising solid and/or tubular support rods, preferably of light-weight material, suitably attachable to the screen and adapted to be readily secured to special clamps mounted on an emergency vehicle or to be driven into the ground or attached to support feet similar to the familiar camera tripods used in the fields of photography and movie film production. In most cases such tubular support rods and their connections to other elements comprise telescopical arrangements of suitable kind.

Another object of the invention is the provision of a screening arrangement for the purpose indicated, in which two or more screens of the type indicated above are mounted one on top of the other to thereby increase the total height of the screening device.

A further object of the invention is to provide a screen for the purpose indicated, which is adapted to have attached thereto one or more guy lines to be securely anchored to adjacent stationary objects, such as ground stakes, trees, telephone poles, fence poles, parked emergency vehicles or the like in order to prevent bending, breaking or toppling of the tubular support rods under the influence of stress and pressure exerted on the screen by strong winds or the like.

Figure 4:
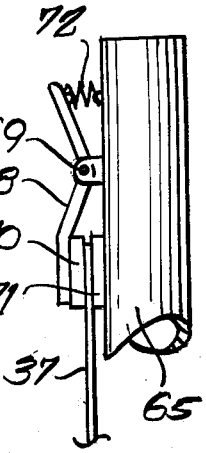
Figure 5:
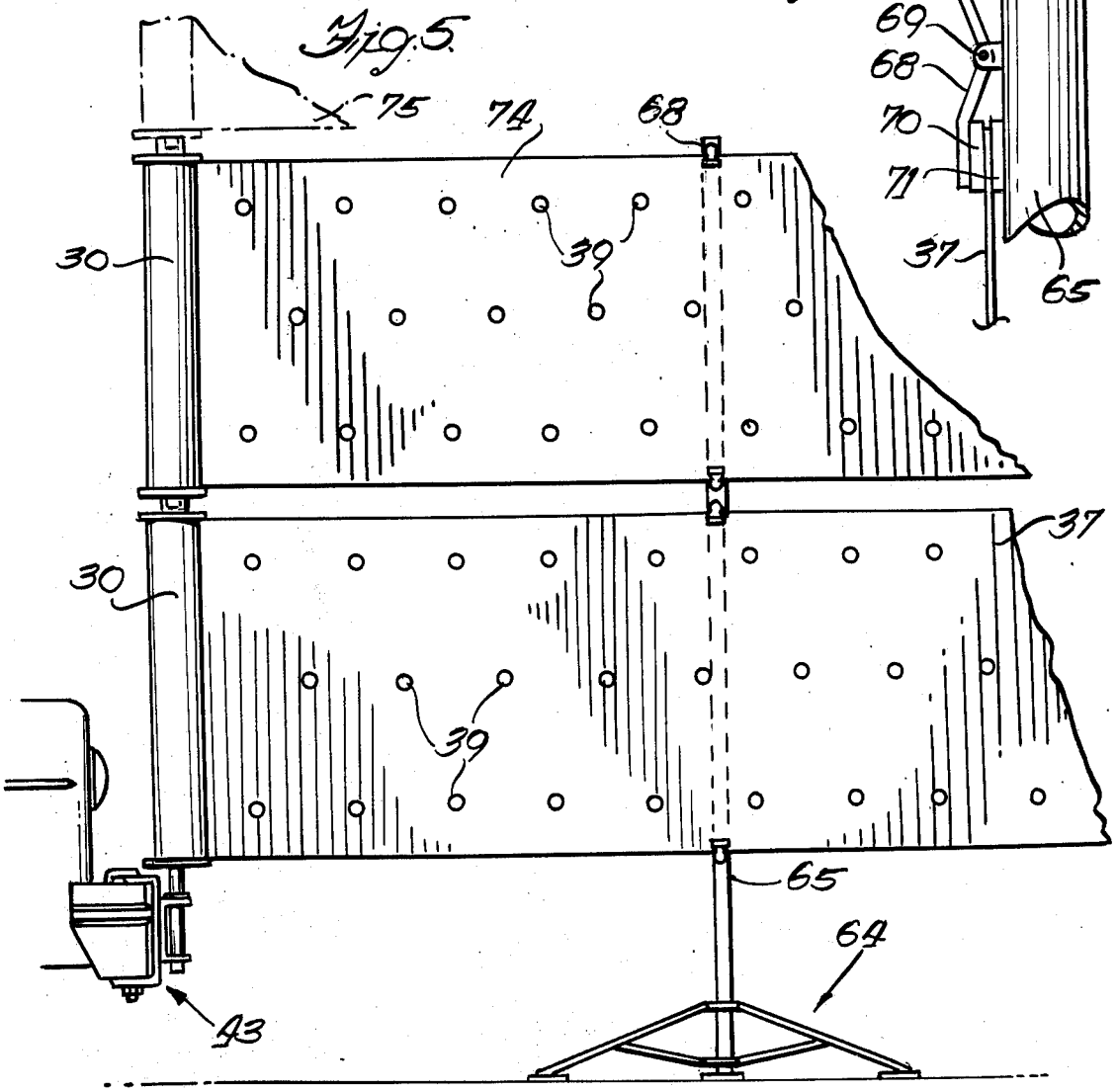
Figures 2, 3:
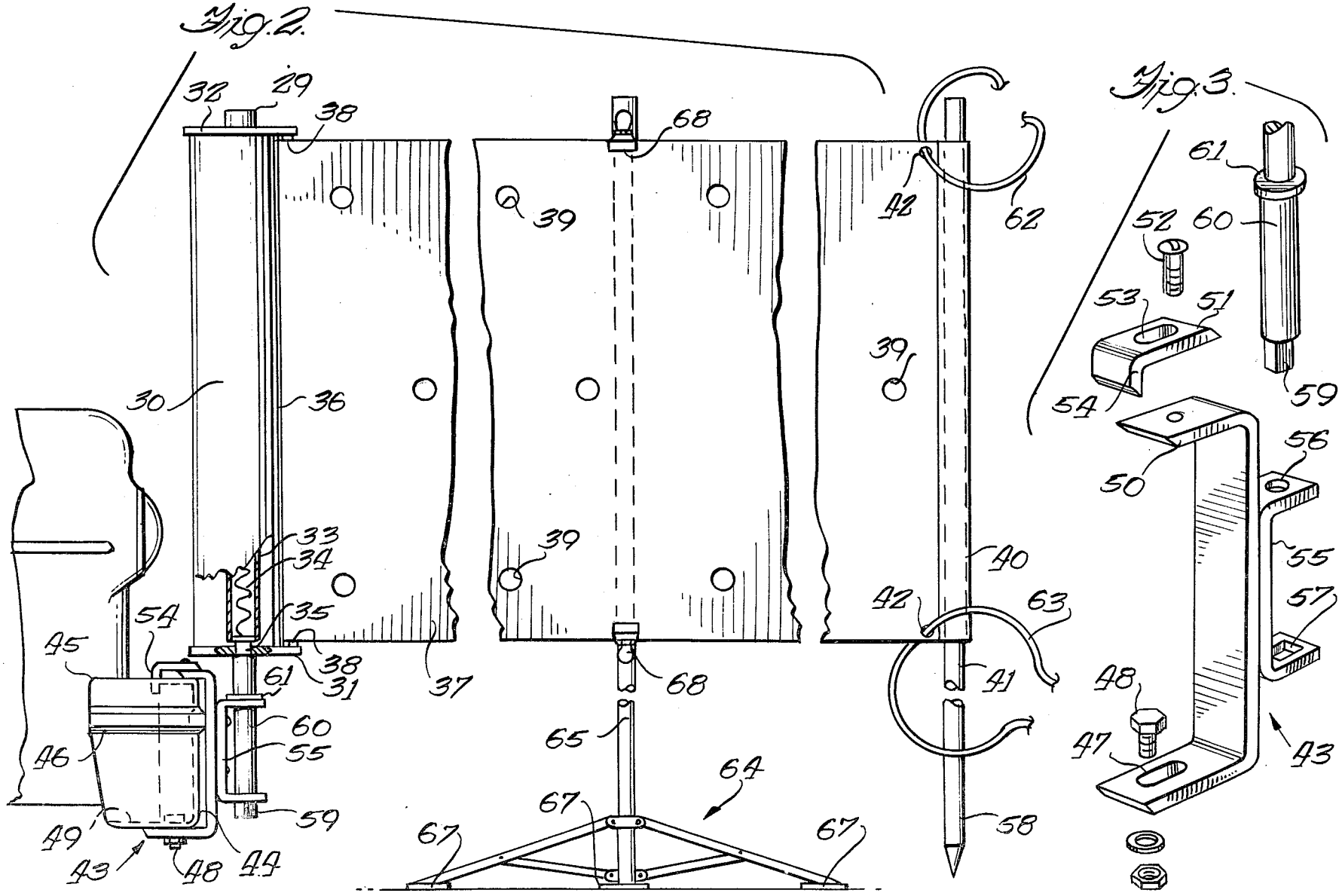

Additional objects and features of the invention will be apparent from the following detailed description taken in conjunction with the accompanying drawings, in which FIG. 1 is an overhead view of an accident site at the edge of a three-lane expressway, FIG. 2 is a side view of the erected screening device according to the invention, FIG. 3 is a perspective view of a clamping device for supporting the screening device on the bumper of an emergency vehicle, FIG. 4 shows a detail of another supporting means for the screen, and FIG. 5 shows, in side elevation, an erected screening device with a second and a third similar screen mounted on top thereof.

In FIG. 1 a section of an expressway is shown as an example, which has three traffic lanes 10, 11, 12 in one direction and three traffic lanes 13, 14, 15 in the opposite direction, as indicated by arrows 16 and 17, respectively. Outside of lane 10 there is a shoulder 18 and outside of lane 15 is another shoulder 19, while the space between lanes 12 and 13 is occupied by a double shoulder 20 divided longitudinally by a fence 21.

An automobile 22 travelling in lane 12 is depicted as having been hit from behind by a trailer truck 23 causing the truck to jack-knife and causing both vehicles to be partially thrown off from lane 12 onto the shoulder 20, both vehicles in this example shown remaining in upright position. One or more occupants of the vehicles may have sustained injuries and, perhaps, been thrown to the ground. Even if the two vehicles 22, 23 directly involved in the accident have come to a halt entirely on the shoulder 20, the drivers of vehicles following the truck in lane 12 will in most cases stop or at least slow down in order to bring help or just plainly to "gawk" at the scene, and in the present case the vehicles in lane 12 will eventually attempt to change to lane 11. In either case a serious traffic jam will occur, usually with vehicles accumulating in long lines behind the accident site. Similar traffic congestion usually occurs in one or more of lanes 13, 14, 15 for assistance and/or curiosity reasons.

According to the present invention the first emergency vehicle 24 to arrive at the scene parks behind the truck 23 with its warning lights flashing, and its occupants — policemen, firemen, or state troopers, etc. — proceed to erect a screening device routinely carried in the emergency vehicle. As more such vehicles arrive, a continuous screen 25 is rapidly erected in lane 12 and subsequently on the opposite side of the accident site on the shoulder 20, as at 26, to effectively screen off the accident site from view in all directions and thus prevent traffic jams caused by curious "gawkers".

The design and construction of the inventive screen will now be described in detail with reference to the drawings. As shown in FIG. 2, the screening equipment carried in the emergency vehicle includes a cylindrical container 30 provided with closure plates 31, 32 at both ends. Extending centrally through said container 30 is a tube 33 which is constructed and rotatably connected with the closure plates 31, 32 in the same manner as an ordinary curtain rod of the kind containing a coil spring 34 having one end secured to a member 35 which is rotatably connected with the tube 33 and non-rotatably mounted in the plate 31, while the other end of the spring 34 is secured to the tube 33 at the opposite end thereof. The container 30 is provided with a longitudinal slot 36, through which extends a thin sheet 37 of a flexible material to be described below. One end of said sheet 37 is secured to the tube 33 in the manner of a shade or curtain to a curtain rod, while the opposite end of the sheet is adapted and/or provided with means to prevent passage through the slot 36 into the container 30. A round rod 38 with a smooth surface may be secured to the plates 31, 32 in the vicinity of the slot 36 to prevent frictional damage to the sheet by the edges of the slot 36, as it is moved therethrough.

The sheet 37 may be made of a cloth-backed vinyl or similar material and provided with perforations 39 of a size and spacing to relieve wind pressure on the sheet, when in position of use, as described below. The perforations 39 are sufficiently small to prevent easy viewing therethrough, particularly from a moving vehicle. A preferred width of the sheet, or screen, 37 is approximately 3.5 feet, while the length may vary considerably as, for example, from about 10 to about 50 feet. At its free end the screen is folded or otherwise adapted to form a transverse sleeve 40 for receipt of a supporting post 41, as further described below, and immediately beside said sleeve 40 the screen is provided with a hole 42 close to each longitudinal edge of the screen for a purpose to be explained. When in storage or carried by an emergency vehicle, the screen 37 is tightly wound around the tube 33 with the spring 34 under minimal tension and with the sleeve 40 immediately outside the slot 36 in the container 30. The arrangement of the spring 33 is such as to place the same under ever increasing tension, as the screen is being pulled out of the container 30.

Each emergency vehicle (police or patrol car 24, etc.) carrying one or more container 30 with the screen 37 in rolled-up condition therewithin is preferably provided with means for easy and speedy mounting and retaining of the container 30 thereon in an upright position. Said means are in the form of one or more substantially U-shaped clamps, generally indicated at 43 in FIG. 2 and shown on a larger scale in FIG. 3, and intended to be permanently attached to a bumper of the vehicle. As such bumpers vary considerably in size and shape for different makes of automobiles, and even for the front and rear ends thereof, it is obvious that the clamps must be modified accordingly. The bumper chosen as an example in this case for the purpose of illustration comprises a heavy metal shield 44 extending across the front or rear end of the vehicle and having end portions 45 bent back somewhat along the sides of the vehicle. A protective rubber strip 46 is mounted in a groove in the metal bumper and extends from end to end thereof, as shown in FIG. 2.

The lower leg of the clamp 43 is provided with an oblong slot 47, and a bolt 48 extends through said slot and a hole in the bottom flange 49 of the bumper for securely retaining the members in properly adjusted relation to each other with the web of the clamp in engagement with the rubber strip 46. The upper clamp leg 50 has an extension member 51 secured thereto by means of a threaded bolt 52 which extends through an elongated slot 53 in the member 51 into a threaded hole (not shown) in the flange 50. The member 51 has its free end portion 54 bent downwardly for engagement with the edge of the bumper shield, as shown. To the outside of the clamp web a second U-shaped member 55 is secured which has an upper leg provided with a circular hole 56 and a lower leg provided with a rectangular hole 57 in vertical alignment with hole 56.

The closure plate 31 of the container 30 has secured to the outer side thereof a rod 60 extending axially of the container 30. Said rod 60 has an end portion 59 of a sectional shape corresponding to that of the hole 57, and the rod 60 may also be provided with a circular flange 61 in a position to rest on the upper flange of member 55, when the end portion 59 of the rod 60 is engaged in the hole 57. Thus, the container 30 may be retained by the bumper clamp 43 in upright position and with the slot 36 facing in any one of two (or more) directions. If desired, the rod 60 may be provided with a locking bolt (not shown) to prevent its unintentional removal from the clamp.

The post 41 comprises, in the example shown, a tube which at both ends of the receiving sleeve 40 extends somewhat beyond the same. It may be carried on the emergency vehicle either inserted in the sleeve 40 or separately therefrom. In the latter case, it is preferably inserted into the sleeve, before the screen 37 is pulled out of the container 30 by more than a few inches. The screen 37 is then further pulled out to the desired length, and the tubular post 41 is telescopically connected with, for example, a rod similar to rod 60 which is then or previously connected with a clamp on a second emergency vehicle (not shown) parked in the proper place.

An anchoring cord 62 is inserted through the top hole 42 in the screen 37, as shown, and tied to a stationary object, such as a tree, a post of the fence 21, a spike driven into the ground or the pavement, or even a part of the emergency vehicle at a suitable distance from the post 41 in the proper direction to prevent the post 41 to bend over towards the container 30 under the influence of tension in the screen. If desirable, a similar cord 63 may be inserted through the bottom hole 42 and anchored in a similar manner. The post 41 may, of course, be continuous through the length of the sleeve 40 or, alternatively, composed of two or more telescopically interconnected members. In an alternative embodiment the rod 60 may be replaced by a sturdy spike such as 58 or the like driven into the ground, the pavement or a crack in the same.

At any point along the extended screen 37 a supporting structure, such as indicated generally at 64, may be placed. Said structure comprises a post 65 — continuous or composed of telescopically joined parts — provided with a foldable foot arrangement similar to that of a tripod for a camera. It is not believed that an arrangement of this familiar kind requires any further detailed description. Each "foot" is provided with a ground engaging pad 67, for example made of rubber or a similar material.

At the levels of the upper and lower edges of the erected screen the post 65 is provided with a spring clamp of the kind shown in FIG. 4 in respect of the upper clamp. It comprises a lever 68 which is pivotally mounted on the post at 69 and provided on one arm with a clamping jaw 70 adapted for cooperation with a second jaw 71 secured to the post 65. The other arm of the lever 68 is actuated toward closed position of the clamp jaws by a strong spring 72, as shown. The lower clamp is of the same construction but mounted on the post in reversed position.

The posts 41 and 65, as well as a rod or a piece of tubing 29 secured to the top side of the upper closure plate 32 of the container 30, extend above the upper edge of the screen a sufficient distance for telescopic connection with posts and a screen container, respectively, belonging to a second screen 74 forming an extension upwardly of the screen 37, when required. A third screen 75 may be similarly mounted above said second screen 74. Anchoring cords on the order of cords 62, 63 may, of course, be provided in connection with said second and third screens and, if needed, also for the screen containers. In most cases one (or two) screen has been found sufficient, since the activities on or close to the ground behind the screen usually are what the "gawkers" are most interested in.

It is pointed out that the invention is not restricted in any respect by the specific details described and shown. On the contrary, numerous modifications are included in the scope of the attached claims. Thus, for example, the telescopic connections between portions of the supporting posts 41 and 65 may vary considerably and may in a well known manner include means for limiting the distance by which one portion of said parts may be insertible in its telescopically coordinated portion. Such means may, for example, comprise transverse stop pins, suitably positioned dents, conicity and the like. The same applies to the rod or tube elements 29 and 60 and to all corresponding support elements for the second and further screens above the primary screen 37.

Another possible modification, obvious to any person with some engineering skill, would be to make the clamp 43 of variable height by substituting for its one-piece web two overlapping pieces secured together by bolts through selectable holes in said pieces suitably positioned to adapt the clamp to two or more types and/or sizes of bumpers. The size and distribution of the perforations 39 in the screen may, of course, also vary considerably.

Other modifications and mechanical equivalents are also feasible within the scope of the attached claims.

What I claim is:

1. Portable means for screening off a traffic accident scene and the like from view, comprising —
   a. an elongate container with a longitudinal slot therethrough,
   b. a spring-actuated curtain rod assembly rotatably mounted within said container lengthwise thereof,
   c. a substantially rectangular non-transparent sheet of thin flexible material having one end thereof secured to said curtain rod and extending outwardly through said slot,
   d. thickening means at the other end of said sheet to prevent it from passing into the container through said slot,
   e. connecting means at said other end of the sheet for releasably securing the same to a stationary object, and
   f. adjustable clamping means attached to said container for non-rotatably securing the same in a vertical position to a stationary object, such as the bumper of a parked vehicle, whereby said container may be routinely carried by an emergency vehicle and rapidly erected at the accident scene with the screening sheet extended in a substantially vertical position to shut off the scene from view.

2. Portable means for screening off a traffic accident scene and the like from view, comprising —
   a. an elongate container with a longitudinal slot therethrough,
   b. a spring-actuated curtain rod assembly rotatably mounted within said container lengthwise thereof,
   c. a substantially rectangular non-transparent sheet of thin flexible material having one end thereof secured to said curtain rod and extending outwardly through said slot,
   d. thickening means at the other end of said sheet to prevent it from passing into the container through said slot,
   e. connecting means at said other end of the sheet for releasably securing the same to a stationary object, and
   f. adjustable clamping means attached to said container for non-rotatably securing the same in a vertical position to a stationary object, such as the bumper of a parked vehicle, said adjustable clamping means including an assembly permanently mounted on the bumper of an emergency vehicle and having superimposed flanges projecting substantially horizontally therefrom, with aligned openings in said flanges to receive a rod-shaped member of the clamping means secured to and depending from said container, at least one of said openings being non-circular to fit a similarily shaped portion of said rod-shaped member, when inserted, and thereby prevent rotational movement of said container, whereby said container may be carried by said vehicle and rapidly erected at the accident scene with the screening sheet extended in a substantially vertical position to shut off the same from view.

3. Means as set forth in claim 2, in which said assembly mounted on the bumper of the emergency vehicle is adjustable to fit bumpers of various sizes and shapes.

4. Portable means for screening off a traffic accident scene and the like from view, comprising —
   a. an elongate container with a longitudinal slot therethrough,
   b. a spring-actuated curtain rod assembly rotatably mounted within said container lengthwise thereof,
   c. a substantially rectangular non-transparent sheet of thin flexible material having one end thereof secured to said curtain rod and extending outwardly through said slot,
   d. thickening means at the other end of said sheet to prevent it from passing into the container through said slot,
   e. connecting means at said other end of the sheet for releasably securing the same to a stationary object, and
   f. adjustable clamping means attached to said container for non-rotatably securing the same in a vertical position to a stationary object, such as the bumper of a parked vehicle, said portable means including an intermediary sheet support which comprises a tubular rod provided at one end with a ground-engaging structure similar to a foldable camera tripod and at the level of the upper and lower edges of the erected screen with a screen-clamping device, said screen-clamping device comprising a lever pivotally connected with the rod for movement about a horizontal axis and provided at the end of one arm of said lever with a screen-engaging pad adapted for cooperation with a similar pad secured to said rod, a compression spring being inserted between the other lever arm and said rod to bias the pads toward engagement with each other.

5. Portable means for screening off a traffic accident scene and the like from view, comprising — a. an elongate container with a longitudinal slot therethrough, b. a spring-actuated curtain rod assembly rotatably mounted within said container lengthwise thereof, c. a substantially rectangular non-transparent sheet of thin flexible material having one end thereof secured to said curtain rod and extending outwardly through said slot, d. thickening means at the other end of said sheet to prevent it from passing into the container through said slot, e. connecting means at said other end of the sheet for releasably securing the same to a stationary object, and f. adjustable clamping means attached to said container for non-rotatably securing the same in a vertical position to a stationary object, such as the bumper of a parked vehicle, in which said container, the connection means at said other end of the sheet, and said intermediary sheet support are provided at their upper ends with extension elements adapted for telescopic connection with the lower ends of corresponding support elements of a second screening device forming an extension upwardly of the firstmentioned screening device.

6. Portable means as set forth in claim 5, in which said extension elements are adapted to serve as attachment means for guy lines anchoring the portable means to ground or to stationary objects to counteract bending or toppling tendencies caused by strong winds and the like.

* * * * *